United States Patent [19]

Coursen

[11] 3,973,497

[45] Aug. 10, 1976

[54] DIRECTED-THRUST BLASTING PROCESS

[75] Inventor: David Linn Coursen, Mercersburg, Pa.

[73] Assignee: E. I. Du Pont de Nemours and Company, Wilmington, Del.

[22] Filed: Sept. 24, 1974

[21] Appl. No.: 508,888

[52] U.S. Cl. ..... 102/23; 299/13

[51] Int. Cl.[2] ..... F42D 3/00

[58] Field of Search ..... 102/22, 23; 166/299; 299/13

[56] References Cited

UNITED STATES PATENTS

| | | | |
|---|---|---|---|
| 60,572 | 12/1866 | Shaffner | 102/23 |
| 2,772,632 | 12/1956 | Aitchison et al. | 102/23 |
| 3,024,727 | 3/1962 | Hradel | 102/23 |
| 3,466,094 | 9/1969 | Haworth et al. | 299/13 |
| 3,792,906 | 2/1974 | Kuck | 299/13 |
| 3,863,987 | 2/1975 | Lampard | 102/23 |

*Primary Examiner*—Verlin R. Pendegrass

[57] ABSTRACT

Directed thrusts are generated in rock by detonating explosive charges in groups of drill holes therein, the drill holes being aligned so that the maximum thrust from the substantially simultaneous detonation of charges in a group of holes is exerted in a direction close to one in which the rock has been found to be particularly vulnerable to failure, i.e., a direction that is at an angle of 60° to a representative normal of a densely populated set of joints in the rock and that also is close to a direction of maximum principal tectonic stress should one be found.

17 Claims, 8 Drawing Figures

DIRECTED-THRUST BLASTING PROCESS

BACKGROUND OF THE INVENTION

1. Field of the Invention

The present invention relates to a method of blasting wherein one or more explosive thrusts are generated in rock in directions in which the rock has been found to be particularly vulnerable to failure.

2. Description of the Prior Art

Blasting processes have long provided man with a powerful tool for performing useful work, affording the energy required, for example, for excavation operations of various kinds, i.e., operations in which material is dug out and removed at or below the earth's surface either to form a useful cavity or to derive profit from the removed material, e.g., in mining. More recently, blasting processes for fracturing deep rock have become increasingly important as it has become necessary to tap deep mineralized rock masses, e.g., ore bodies or oil or gas reservoirs located from about 100 feet to about a few thousand feet beneath the earth's surface, in order to supplement or replace dwindling energy sources and minerals supplies. The fracturing procedure is required to prepare the masses for such in situ recovery operations as leaching of ore or retorting of oil shale in place.

The preparation of large volumes of deep rock for in situ operations by blasting requires the emplacement of enormous amounts of explosives in the regions to be fractured, which in turn entails the drilling of vast numbers of shot holes therein. To some extent, drilling costs can be reduced by drilling holes of smaller diameter than is required to accommodate the size of the explosive charges to be employed, and enlarging or "springing" the lower parts of the shot holes, located in the segment of rock to be fractured, to produce chambers having the volumes required to hold the explosive charges. Nevertheless, the costs of such large blasts will be substantial. Therefore, any procedure which can increase the effectiveness of the blasting process, i.e., produce more useful work (e.g., fracturing) in a given volume of rock per weight of explosive used, and thereby allow larger separations between shot holes or a smaller explosive charge per shot hole would add considerably to the value of the blasting process.

SUMMARY OF THE INVENTION

The invention provides a method of generating a directed thrust, and preferably a succession of directed thrusts, in rock, each by the substantially simultaneous detonation of explosives in an oriented coplanar group of holes in the rock, comprising:

a. forming one or more groups of drill holes in the rock, the holes in each group being a rank of adjacent holes lying substantially in a common plane whose normal defines a predetermined thrust direction, and said plane being oriented in a manner such that the thrust direction is within about 20° of, and preferably substantially coincides with, a direction in which the rock has been found to be particularly vulnerable to failure by virtue of existing jointing anisotropy and possibly also by virtue of anisotropic tectonic stresses;

b. loading the drill holes with explosive charges; and c. detonating the charges in each group of drill holes substantially simultaneously, whereby the group-detonation exerts a thrust against the rock in the predetermined thrust direction. With multiple groups of drill holes, the substantially simultaneously detonated groups of charges are detonated in succession with respect to other such groups, the time interval between the detonations of successive groups of charges being sufficient to permit the pressure in the vicinity of the next group of charges to return to its ambient level.

Directions in which the rock is particularly vulnerable to failure are thrust directions which are optimum for sliding the joints in a densely populated set of joints in the rock, especially joints that are already under shear stress for sliding in the same direction, owing to existing tectonic stresses in the rock. Accordingly, a direction of vulnerability to failure generally will be a direction which is at an angle of 60° to a representative normal of a densely populated joint set in the rock, and preferably also close to a direction of maximum principal tectonic stress if the rock is under anisotropic tectonic stresses.

Because the common plane in which the drill holes of each group lie has its normal oriented along the maximum thrust exerted by the detonations in the holes of the group, this normal is purposely oriented close to a direction of the rock's vulnerability to failure. This orientation of the plane containing the drill holes allows the energy produced by the detonation to work in combination with the pre-existent directions of weakness in the rock, thus utilizing the explosive energy more effectively and thereby reducing the cost of explosive fracturing processes.

In the present process, explosive charges in a plurality of drill holes are detonated in a manner such that there is at least one, and preferably a succession of multiple-hole detonations, each detonation being a group-detonation, i.e., the substantially simultaneous detonation of charges in a group of adjacent holes in rank. The holes in each group or rank lie substantially in a common plane and their detonation exerts a maximum thrust normal to the common plane, i.e., in a horizontal direction when the plane is substantially vertical. Consequently, a succession of detonations produces a succession of thrusts into the surrounding rock mass, the direction of each thrust being dependent on the orientation of the common plane in which the holes of the group lie. In the present process, the orientation of the common plane is such that the thrust direction, i.e., the normal to the plane, is aligned in a direction chosen to cause maximum shear displacement of existing joints in the rock. To accomplish this, the common plane has a normal that is oriented at an angle close to (i.e., ± about 20°) 60° to the normal of a densely populated joint set in the rock. In some cases, there may be more than one direction of dense jointing, and the common planes of some drill hole groups can be oriented so that the explosive thrust will be exerted to cause maximum sliding of one set of joints, and the common planes of other drill hole groups to cause maximum sliding of another set of joints.

In the present process the orientation of the common plane of the group of drill holes is related to the jointing and stresses in the rock, but the orientation of this plane with respect to the horizon is not critical. However, in most blasting situations the holes will lie in a substantially vertical common plane, and the maximum thrust exerted by the group-detonations therefore usually will be substantially horizontal. Accordingly, the direction of the rock's vulnerability to failure generally is referred to herein as a horizontal direction, and the tectonic stress as a horizontal stress.

Figure 1:
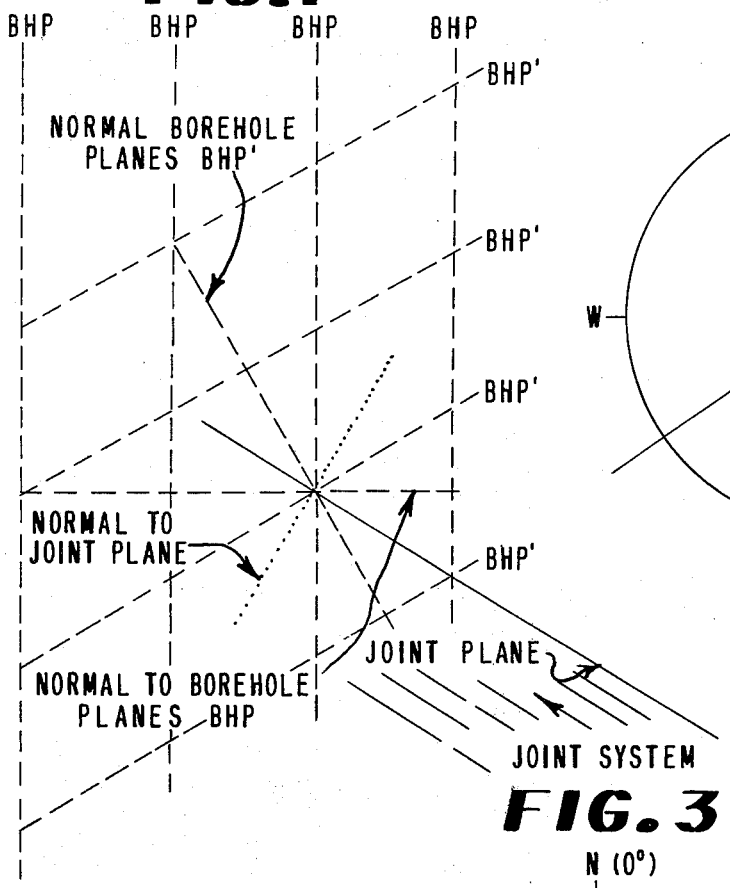
FIG. 1 is a schematic representation showing the edges of planes in which drill holes are to be located with respect to a specific joint system in the present process.

Referring now to FIG. 1, the lines (dashed) denoted as BHP represent the edges of a first set of parallel vertical borehole planes spaced evenly apart from one another. Lines BHP′ (dashed) represent the edges of a second set of evenly spaced-apart parallel vertical borehole planes that intersects the first set. Multiple, spaced boreholes are to be drilled in one or both of the borehole planes. The normals to the two sets of borehole planes (dashed lines) are horizontal and are oriented at an angle of 60° to the normal (dotted line) of a plane of the indicated densely populated vertical joint system. In this manner the thrusts from the detonations of explosive charges in the holes in borehole planes BHP and BHP′, which are normal to planes BHP and BHP′, are made at an angle of 30° to the plane of the joint system. Thrusts made at such an angle generally are optimum for sliding the joints existent in the rock. When the tectonic stresses in the rock are such that a maximum principal tectonic stress is not present, a single joint plane system preferably is subjected to a succession of thrusts from alternately reversed directions, e.g., by the simultaneous detonation of a group of charges in a BHP plane alternating with the detonation of a group of charges in a BHP′ plane (FIG. 1). In this manner, the thrust of each group-detonation reverses the direction of shear from the thrust of the previous detonation. Two joint plane systems can be worked by generating a succession of thrusts from alternately different directions, one to preferentially shear the joints in the first system, followed by a thrust from a different direction to preferentially shear the joints in the second system.

In the present process, when the rock is found to be under anisotropic tectonic stresses, i.e., when the difference between the maximum and minimum principal tectonic stresses is 200 psi or more, the normal of the common plane of each group of boreholes preferably also is as close as possible to the direction of maximum principal tectonic stress (horizontal stress for a vertical plane). In such a case, blasting will reinforce the tectonic shear and the set of joints will fail more easily. The blasting thrusts should be exerted so as to persistently shear the set of joints showing the greatest tectonic stress, and the thrusts should be in the same direction that reinforces the tectonic stress.

Prior to laying out a drill hole pattern in the present process, it is necessary to identify the various directions in which the rock to be blasted is most densely jointed. Often, the jointing will be relatively simple, with the great majority of the joints easily being assigned membership in a major set of joints by inspection, the joints in each major set being nearly parallel and the mean direction of each major set being clearly distinct from the mean direction of every other major set. In such cases, the directions in which the rock is most densely jointed can often be closely estimated by measuring the colatitude and azimuth of the normal (that is, the amount of dip and its compass direction) of a typical joint in each set. The proportion of joints belonging to each set can be estimated by choosing a random sample of joints and counting those that belong in each major set, assignment of each joint to a set being done by inspection.

In most cases, however, such a direct approach will not be acceptable owing to the complexity of the jointing system or the limited amount of data available, or the desirability of avoiding bias arising from the assignment of joints to a set by inspection. Well-developed methods exist for obtaining the directions of most dense jointing in such cases. Such methods are described, for example, in *Structural Geology*, M. P. Billings, Ed. 3, Englewood Cliffs, N.J., Prentice Hall Inc., 1972; and in the United States Bureau of Mines Reports of Investigations RI 7669 (Mahtab et al., 1972) and RI 7715 (Mahtab et al., 1973). Typically, these methods involve (a) measuring the colatitude and azimuth of the normal of each joint in a randomly chosen set of, for example, 100–1000 joints; (b) plotting these measured coordinates of each normal as the point where it will intersect a sphere centered on the normal, and (c) determining the density of the plotted points as a function of position on the surface of the sphere. This density usually is expressed as a percentage of the plotted points that lie within a circular area centered on the point to be assigned a density, each circular area having 1/200 of the area of the surface of the sphere. Such a circular area is one whose radius subtends 10.37° from the center of the sphere. Those positions on the surface of the sphere where the density of plotted points reaches relatively high values represent the normals to planes in the rock that are nearly parallel to relatively large proportions of the joints. A Lambert azimuthal equal-area (or Schmidt) projection can be used to make an equivalent plot in a plane instead of on a spherical surface.

The strikes and dips can be measured on oriented core, or on exposed joints on nearby underground or surface outcrops. One may use, for example, an acoustic imaging and mapping method wherein acoustic signals are reflected from anomalies in the surrounding rock with the emitting and receiving transducers mounted in a drill hole drilled in the rock, as described in Engineering & Mining Journal, Feb. 1970, pp. 93–96.

In the present process, a direction of most dense jointing is a direction such that at least 5% of a measured random sample of joint normals lie within 10.37° of it, and preferably such that it coincides with the mean direction of all joint normals lying within 10.37° of it.

The mean direction of a group of joint normals (in this case, for a group of joints that are nearly parallel) can be calculated from the measured dips and azimuths by Relationships (4) and (5) found on pages 8 and 9 of the above-mentioned Bureau of Mines Report of Investigations RI-7669, as follows:

$$\hat{\phi}_j = \tan^{-1} \frac{[(\epsilon l_i)^2 + (\epsilon m_i)^2]^{1/2}}{\epsilon n_i}$$

$$\hat{\sigma}_j = \tan^{-1} \frac{\epsilon m_i}{\epsilon l_i}$$

where $l_i = \sin \phi_i \cos \sigma_i$ $m_i = \sin \phi_i \sin \sigma_i$ $n_i = \cos \phi_i$ $i = 1, 2, — N$ $j = 1, 2, — M$ *and*

$\hat{\phi}_j$ = mean dip of a group of joints designated $j$ (that is, the colatitude of the mean normal of the group of joints)

$\hat{\sigma}_j$ = azimuth of the mean dip of the group of joints (that is, azimuth of the horizontal component of the mean normal of the group of joints)

$N$ = number of joints whose normals plot within the circle having 1/200 of the area of the sphere $M$ = number of most densely jointed directions $\phi$ i = dip of the ith joint $\sigma$ i = azimuth of the dip of the ith joint.

A direction of dense jointing ($\hat{\phi}_j$, $\hat{\sigma}_j$) which also coincides with the mean direction of all joint normals lying within 10.37° of it, can be found by the following process of successive approximations. Any of the directions of dense jointing close to a local density maximum is chosen as a starting point, or a local density maximum calculated by a computer program such as that described in the United States Bureau of Mines Information Circular IC-8624, *A Computer Program for Clustering Data Points on the Sphere* (Shanley et al., 1974) can be used. The mean direction of all measured joints lying within 10.37° of this first direction is calculated, using the relationships given above. The calculated direction becomes a new starting point and again the mean direction of the new set of joints lying within 10.37° of it is calculated. The procedure is repeated until the calculated mean direction coincides with the one previously calculated.

Directions of vulnerability to failure are found by determining the horizontal directions ($\beta_j$ and $\beta_j'$) that make an angle of 60° with the normals that map each of the most densely jointed directions dipping at least 30° (i.e., for which $30° \leq \hat{\phi}_j \leq 90°$.

For dense jointing that is along vertical or nearly vertical planes, whose normals therefore lie within a few degrees of the horizontal plane, and which therefore have values of $\hat{\phi}_j$ that are close to 90°, this is easily done by simply taking compass directions ($\beta_j$ and $\beta_j'$) that are ± 60° from the value of $\hat{\sigma}_j$ corresponding to each of these densely jointed directions. In the general case, however, $\beta_j$ and $\beta_j'$ can be found graphically or by solving the following equation for $\beta_j$, for each of $M$ directions that are most densely jointed directions:

$$\beta_j = \hat{\sigma}_m - \cos^{-1} \left[\frac{\cos 60°}{\sin \hat{\phi}_j}\right]$$

This equation will have two solutions ($\beta_j$ and $\beta_j'$) for $30° < \hat{\phi}_j < 150°$, one solution for $\hat{\phi}_j = 30°$(or 150°) and no solutions for $0° \leq \hat{\phi}_j < 30°$and $150° < \hat{\phi}_j \leq 180°$.

| | |
|---|---|
| Lemma: $\hat{\phi}_j$, $\hat{\sigma}_j$ | dips and azimuths of dense jointing directions having direction cosines ($\hat{l}_j$, $\hat{m}_j$, $\hat{n}_j$) |
| $\alpha_j$, $\beta_j$ | dips and azimuths of directions that are inclined 60° to ($\hat{\phi}_j$, $\hat{\sigma}_j$) with direction cosines ($l_j$, $m_j$, $n_j$) |

$$\cos 60° = \hat{l}_j l_j + \hat{m}_j m_j + \hat{n}_j n_j = \sin \hat{\phi}_j \cos \hat{\sigma}_j \sin \alpha_j \cos \beta_j + \sin \hat{\phi}_j \sin \hat{\sigma}_j \alpha_j \sin \beta_j + \cos \hat{\phi}_j \cos \alpha_j$$

For horizontal directions, $\alpha_j = 90°$ $$\therefore \cos 60° = \sin \hat{\phi}_j \cos \hat{\sigma}_j \cos \beta_j + \sin \hat{\phi}_j \sin \hat{\sigma}_j \sin \beta_j$$

$$\therefore \frac{\cos 60°}{\sin \hat{\phi}_j} = \cos \hat{\sigma}_j \cos \beta_1 + \sin \hat{\sigma}_j \sin \beta_j = \cos (\hat{\sigma}_j - \beta_j)$$

$$\cos^{-1} \left[\frac{\cos 60°}{\sin \hat{\phi}_j}\right] = \hat{\sigma}_j - \beta_j$$

$$\beta_j = \hat{\sigma}_j - \cos^{-1} \left[\frac{\cos 60°}{\sin \hat{\phi}_j}\right]$$

Preferably the magnitude and direction of the horizontal components of the tectonic stress in the rock is also determined. This can be done by any one of several stress relief methods or by an hydraulic fracturing method.

The stress relief methods all rely on either measurement of the change in dimensions exhibited by a small volume of rock when it is cut loose from a rock formation that is under stress, or on measurement of the stresses required to restore the original dimensions to such a volume of rock (F. T. Williams and A Owens, Tunnels & Tunnelling (London) 5, 138–42 (1973) No. 2).

The hydraulic fracturing method, as presently practiced, relies on a determination of the hydraulic pressures required to initiate fracture of the wall of drill holes in an unstressed sample, and also of a drill hole in the formation in question, and the pressure required to hold the latter fracture open, once it is formed, and the compass orientation of the fracture in the borehole wall. This method is reviewed by B. C. Haimson, Symp. Soc. Internat. des Roches, Nancy, 1971, Vol. II, Paper No. 30, with a specific example of stress determination in deep rock using this method.

For determination of the magnitude and direction of the horizontal components of the tectonic stress in deep rock accessible only through boreholes drilled down from the surface, the hydraulic fracturing method is the easiest to use at the present state of the art, and is therefore preferred.

If the difference between the maximum and minimum principal horizontal tectonic stresses measured as described above is 200 psi or more, then the value of $\beta_j$ or $\beta_j'$ that is selected is the one which is closest to the measured azimuth of the maximum principal horizontal tectonic stress. If several values of $\beta_j$ or $\beta_j'$ lie within 10° of this direction, and they are derived from directions of appreciably differing jointing density, then the one derived from the more densely jointed direction is selected.

If the difference between the measured minimum and maximum principal horizontal tectonic stresses is less than 200 psi, then one can choose either (a) a value of $\beta_j$ or $\beta_j'$ derived from the most densely jointed direction, or if there are several choices derived from about equal jointing density, preferably one that is close to those from one or more other densely jointed directions or (b) two or three values of $\beta_j$ or $\beta_j'$ that are oriented within 90° ± 10° or 120° ± 10° of each other.

Once the direction(s) of vulnerability to failure ($\beta_j$ and $\beta_j'$) have been found, a two-dimensional pattern of drill hole locations is laid out, the locations being evenly spaced on a horizontal line or on a set of horizontal, evenly spaced parallel lines that are perpendicular to the chosen value (or values) of $\beta_j$ or $\beta_j'$. If several values of $\beta_j$ or $\beta_j'$ have been chosen, then a horizontal line or a set of evenly spaced horizontal parallel lines is laid out perpendicular to each chosen value of $\beta_j$ or $\beta_j'$. A substantially vertical borehole is drilled at each location.

If the rock is to be blasted in a single thrust, all of the drill holes on one horizontal line perpendicular to $\beta_j$ or $\beta_j'$ comprise a single group, and the explosive charges loaded therein are detonated substantially simultaneously. In most instances, however, it will be beneficial to subject the rock to a succession of thrusts and therefore to form multiple groups of drill holes on one or more horizontal lines perpendicular to each chosen value of $\beta_j$ or $\beta_j'$, and to detonate in succession the charges loaded into the groups of holes. Subjecting the rock to multiple explosive thrusts in succession allows one, inter alia, to take advantage of the incremental swelling of fracture zones that is achievable when blasting is conducted in flooded rock, as described in my co-pending U.S. patent application Ser. No. 382,845, filed July 26, 1973 now U.S. Pat. No. 3,902,422. Therefore, in a preferred embodiment of the present process the drill holes form a pattern of multi-hole groups, the holes of each group lying on the same line (i.e., in a common plane), and groups preferably being located on a set of parallel lines (i.e., in a set of parallel planes) with multiple groups per line, and with the groups evenly distributed in plan view. If the difference between the maximum and minimum horizontal principal tectonic stresses has been found to be greater than 200 psi, then the groups of holes are laid out on a set of parallel lines all running in the same direction, i.e., lines perpendicular to the $\beta_j$ which is closest to the direction of the maximum principal tectonic stress. If the difference between the stresses is less, then two intersecting sets of parallel lines perpendicular to $\beta_j$ and $\beta_j'$ may be constructed and groups of holes drilled on both sets of lines.

The explosive charges in each drill hole group are detonated substantially simultaneously, and the groups are detonated in succession. When the holes lie in intersecting planes, the detonation of a group of holes in one of the sets of planes alternates with that of a group of holes in the other set. The time between successive group-detonations is sufficient to permit the pressure resulting from one detonation to return to its ambient level in the vicinity of the next group in the succession. As a rule, when the successive groups of holes are adjacent to each other, the time interval between group-detonations is at least $2d/C$, where $d$ is the spacing between a hole in one group and a hole that is closest thereto in an adjacent group, and C is the velocity of compressional waves in the rock.

The size of the drill hole groups can vary, e.g., about from two to eight holes per group, but in most instances small groups, e.g., groups of about from two to four holes, are preferred in order to avoid vibration problems associated with larger blasts.

Adequate directivity of the thrust of the planar charge group requires that all explosive in the group be consumed in a very short length of time. Variables that tend to reduce such directivity are: large variability in cap initiation times, a high velocity of sound in the rock, a low detonation velocity of the explosive comprising the array, and a large spacing between detonators in a charge. In general, the spacing between detonators in a hole should be governed by the following relation in order that the maximum thrust be exerted in a direction within 10° of the desired direction:

$$R \leqq 2\,D\,[0.03\,\frac{S^2}{C^2}\,\delta^2]^{1/2}$$

where:

$R$ = separation of electrically fired detonators in a borehole $D$ = detonation velocity of the explosive to be initiated $S$ = separation of holes in the group $C$ = velocity of sound in the rock $\delta$ = standard deviation of the explosion times of simultaneously initiated blasting caps, for the type of cap and firing current to be used.

Lemma:

$$(\Delta t)^2 = \delta^2 + T^2 \leqslant (\frac{S}{C}\sin 10°)^2 = (0.17\,\frac{S}{C})^2$$

where $T = \frac{R}{2D}$ and $\Delta t$ = total variability of the initiation points $$\therefore R \leqslant 2D\,[0.03\,\frac{S^2}{C^2}\,\delta]^{1/2}$$

For sufficiently short charges, one detonator per charge should be sufficient, but the use of longer charges requires the use of a larger number of detonators spaced along the charge. Thus, the above equation can be used to specify the required simultaneously of the initiators, and the maximum allowable spacing between initiators having a given timing variability. In general, a charge no longer than $R/2$ can be initiated with a single initiator placed anywhere in the charge, a charge no longer than R can be initiated with a single initiator placed no farther than $R/2$ from either end of the charge, and charges longer than R will require two or more initators separated by a distance no greater than R and no farther than $R/2$ from either end of the charge.

If the rock to be blasted is above the phreatic surface, it is preferable to flood the rock in the vicinity of each group of holes with water before detonating them. If the rock to be blasted is below the phreatic surface, it is preferable to allow ground water to percolate into open fractures left by the previous blast, before the next blast is made adjacent to it. Thus, the present process preferably is carried out in conjunction with the process for blasting in flooded rock described in my above-mentioned co-pending U.S. patent applicatin Ser. No. 382,845 now U.S. Pat. No. 3,902,422, the disclosure of which is incorporated herein by reference. Aluminum-containing water gel explosives are the preferred explosive for this type of blasting because of their high energy density, good water resistance, ability to fill a borehole to high loading density, safety, and reasonable cost.

For boreholes where the barren overburden is at least as thick as the underlying rock, e.g., ore, to be worked by blasting, it is particularly desirable to minimize the amount of drilling required to emplace the charges. This can be done by increasing the volumes of the boreholes at the depths where the charges are to be placed. The volume of a hole can be increased by springing it to a larger volume with one or more preliminary explosive charges or by reaming the deep parts of the hole to larger volume, using an expansion bit.

The following examples serve to further illustrate specific embodiments of the process of the invention.

Example 1

Figure 2:
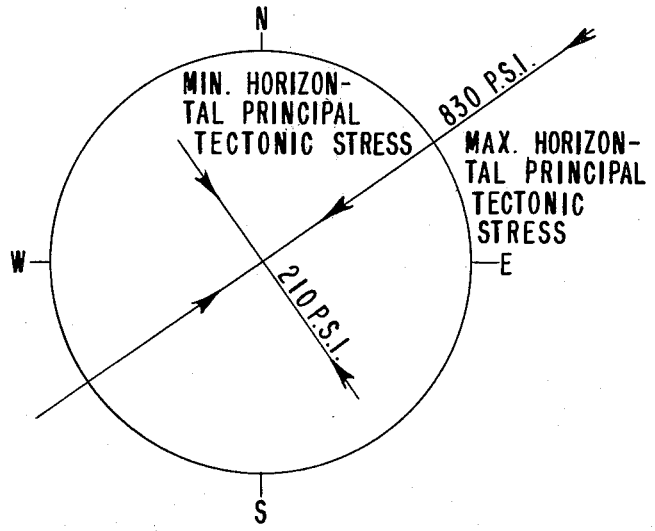
FIG.2 is a plot of the measured principal tectonic stresses described in Example 1.
Figure 3:
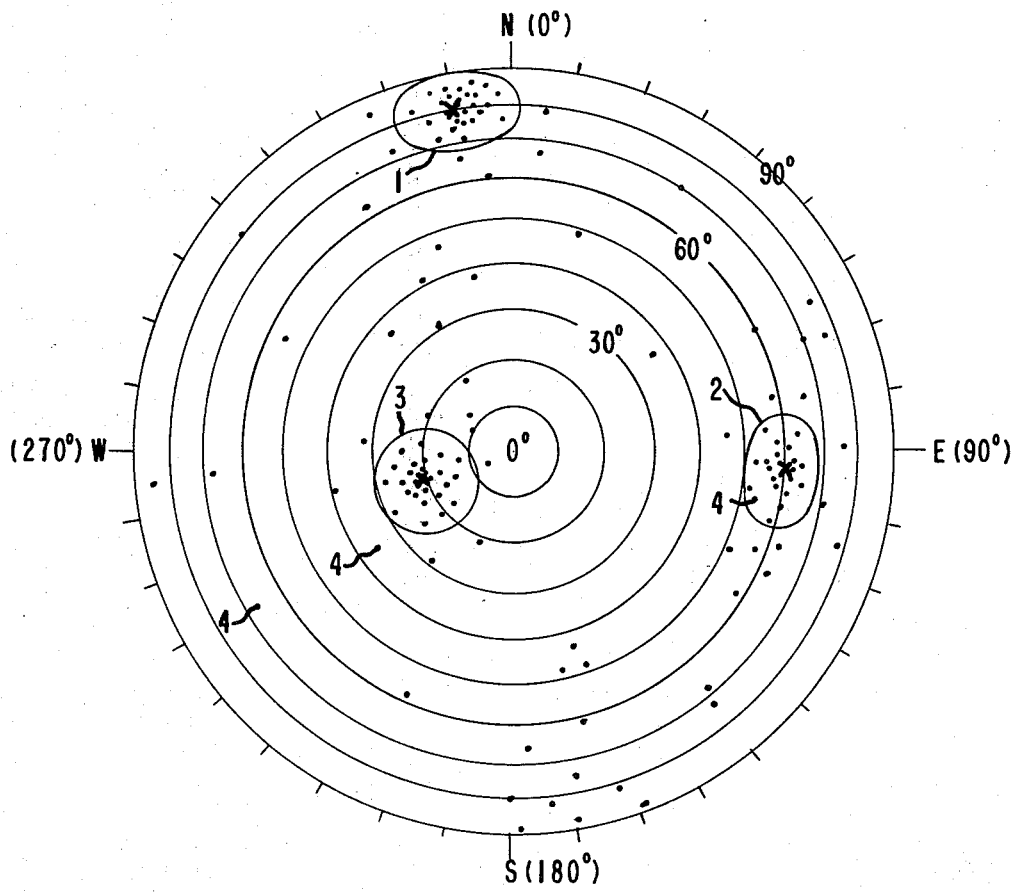
FIG. 3 is a plot of joint normal positions used to determine dense jointing directions as described in Example 1.

A body of copper ore lying between the depths of 320 and 570 feet is to be fragmented by explosives to prepare it for the leaching-out of copper values in place.

a. Three tectonic stress measurements are made by the hydraulic fracturing method at depths of 370, 445, and 520 feet in each of three coreholes drilled into the ore at widely separated positions (about 500 feet apart) in the ore to be blasted. The average horizontal principal tectonic stresses obtained from these measurements, which are plotted in FIG. 2, are:

| | Magnitude (psi) | Azimuth (Degrees True) |
|---|---|---|
| Maximum Horizontal Principal Stress ($\sigma_{11}$) | 830 (Compressive) | 55° |
| Minimum Horizontal Principal Stress ($\sigma_{22}$) | 210 (Compressive) | 145° |

b. The strikes and dips of the joints are measured in oriented core, previously taken with a triple core barrel from the 320–570 feet depth interval in the three holes used in obtaining the tectonic stress condition in Step (a). A Schmidt projection of the resulting data for 131 joints is shown in FIG. 3. In this figure, 4 denotes the plotted positions of joint normals where they intersect the upper half of a sphere centered on the normal; and 1, 2, and 3 denote circles having 1% of the area of the hemisphere (which plot as ovals of the same area on a Schmidt projection) centered on the mean positions of all joint normals that plot in the circle. The several most densely jointed directions are identified by crosses. Their coordinates are as follows:

| | | |
|---|---|---|
| Center of Circle 1: | $\hat{\phi}_1 = 80°$ | $\hat{\sigma}_1 = 350°$ |
| Center of Circle 2: | $\hat{\phi}_2 = 60°$ | $\hat{\sigma}_2 = 95°$ |
| Center of Circle 3: | $\hat{\phi}_3 = 20°$ | $\hat{\sigma}_3 = 250°$ |

c. The horizontal directions that make angles of 60° with the most densely jointed directions found in Step (b) are found by solving the following equation:

For 60° from the joint normal represented by the center of Circle 1:

$$\beta_1 = 350° - \cos^{-1}\left[\frac{\cos 60°}{\sin 80°}\right]$$

The values of $\beta_1$ which satisfy this equation are:

$$\beta_1 = 290.5°, \beta_1' = 49.5°$$

For 60° from the joint normal represented by the center of Circle 2:

$$\beta_2 = 95° - \cos^{-1}\left[\frac{\cos 60°}{\sin 60°}\right]$$

The values of $\beta_2$ which satisfy this equation are:

$$\beta_2 = 40.3°, \beta_2' = 149.7°$$

Figure 5:
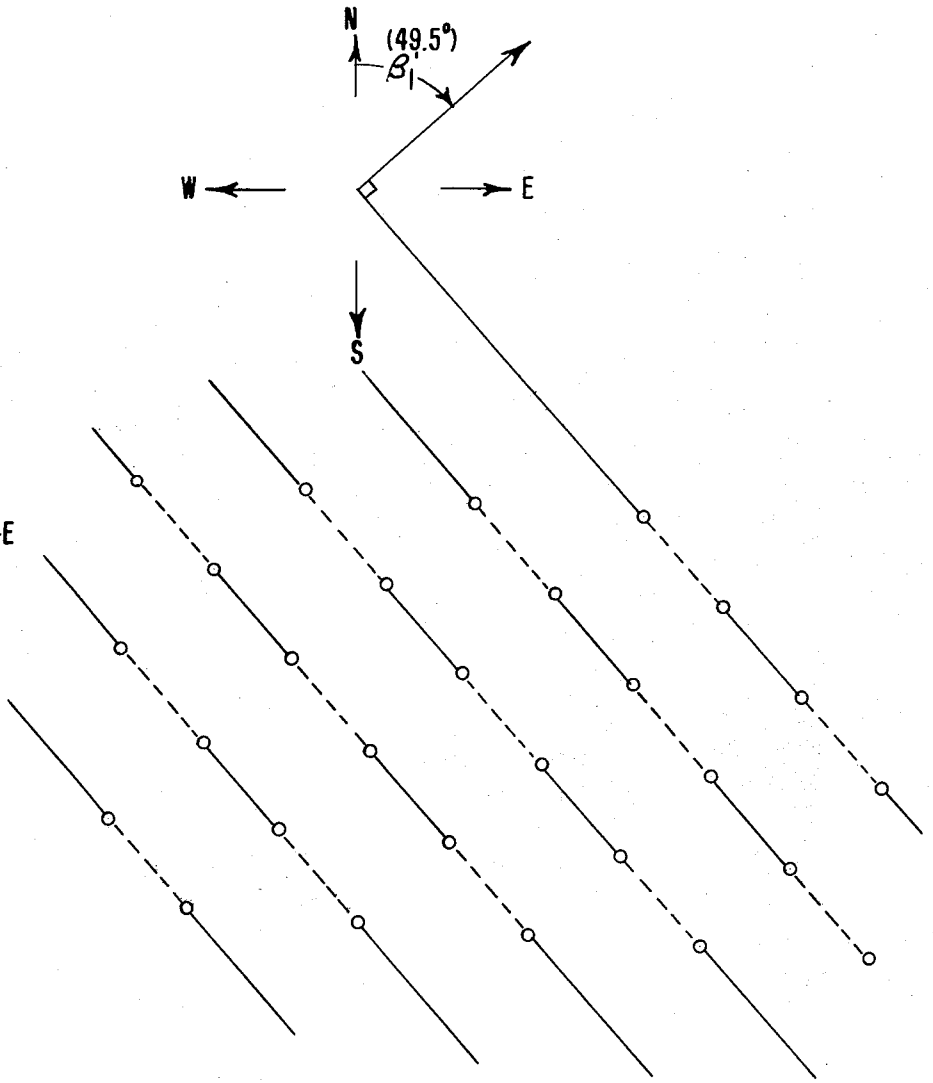
FIG. 5 is a drill hole pattern laid out for the direction of vulnerability to failure found in Example 1.
Figure 4:
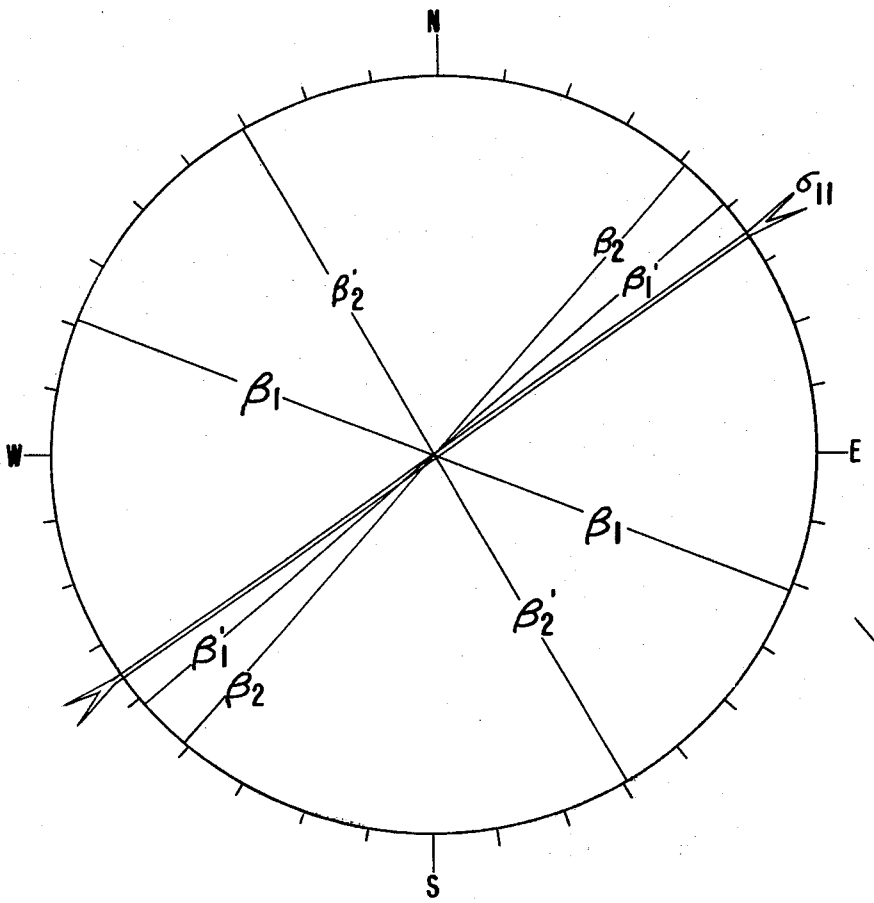
FIG.4 is an angular plot of the direction of maximum principal tectonic stress and dense jointing directions described in Example 1.

No horizontal directions exist that bear 60° from a joint normal represented by the center of Circle 3.

d. The maximum horizontal principal stress direction ($\sigma_{11}$) and the values of $\beta_1$, $\beta_1'$, $\beta_2$, and $\beta_2'$ that represent thrust directions found above to be optimum for shearing joints are plotted in FIG. 4. The direction $\beta_1'$ (49.5°) is seen to be the optimum direction along which to direct the thrust of the explosions, because it is quite close to the direction of the maximum principal stress (55°).

e. Six evenly spaced, horizontal parallel lines are laid out perpendicular to $\beta_1'$, on a spacing appropriate for the separation of ranks of boreholes in this rock, for the charge diameters that are to be used. For example, using an explosive comprising a gelled mixture of 29.6% monomethylamine nitrate, 18.9% ammonium nitrate, 10.5% sodium nitrate, 11.0% water, and 30% powdered aluminum (by weight) in 10-inch-diameter boreholes (to be chambered by reaming) in monzonite porphyry rock, a spacing of about 90 feet between lines is used. Evenly spaced hole positions are laid out on each of these parallel lines, as shown in FIG. 5, the spacing between holes being the same as the spacing between the lines. The substantially vertical boreholes are drilled one or a few at a time and then chambered by under-reaming the ore body in the 320–570 foot interval. This procedure increases the hole volume at this depth interval by a factor of about seven in this rock. Pairs of chambered holes, the holes of each pair lying on the same parallel line (and shown connected by a dashed line in FIG. 5), and the pairs of holes being in staggered position on adjacent lines, are then loaded with the same explosive and one pair of holes detonated at a time so as to exert a succession of thrusts on the rock in the $\beta_1'$ direction. The fragmentation of the ore is increased, as evidenced by a reduction of the average length of core fragments at least 2 inches long to about half the length obtained before blasting.

EXAMPLE 2

An oil shale formation lying between the depths of 600 and 850 feet is to be fragmented by explosives to prepare it for retorting in place.

a. Tectonic stress measurements made by overcoring methods in drill holes bored from underground workings in the shale show that the principal tectonic stresses at these depths are as follows:

| | Magnitude (psi) | Azimuth (degrees true) | Inclination from vertical (degrees) |
|---|---|---|---|
| $\sigma_{11}$ | 1100 (compressive) | 35 | 169 |
| $\sigma_{22}$ | 280 (compressive) | 92 | 100 |
| $\sigma_{33}$ | 170 (compressive) | 181 | 84 |

Figure 7:
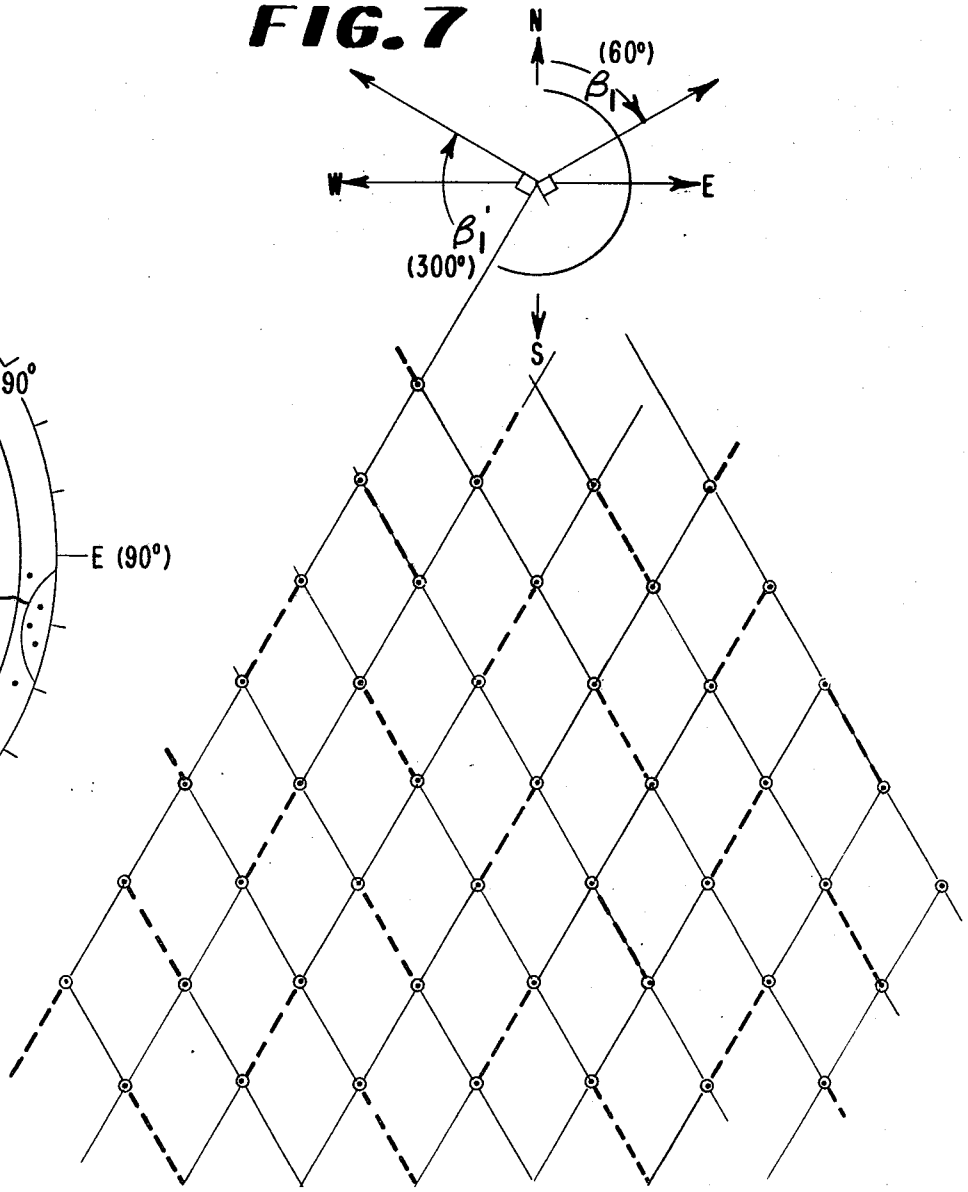
FIG. 7 is a drill hole pattern laid out for the directions of vulnerability to failure found in Example 2.
Figure 6:
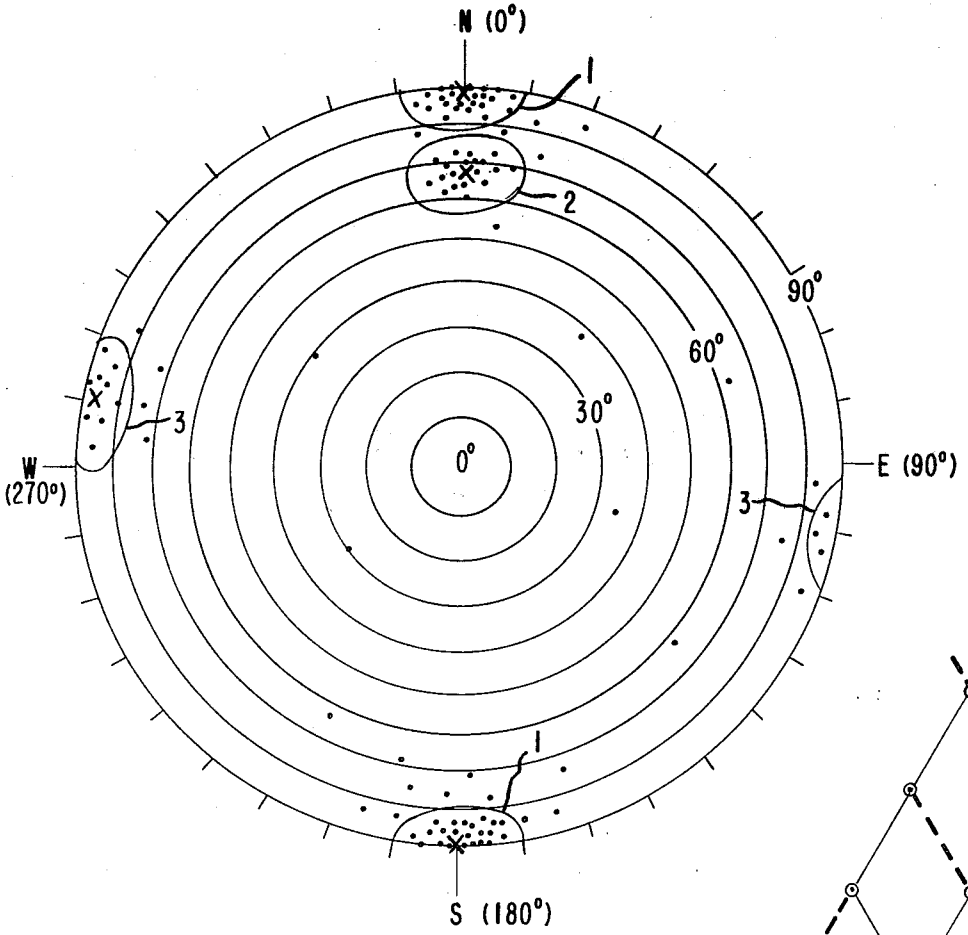
FIG. 6 is a plot of joint normal positions used to determine dense jointing directions as described in Example 2.

Inasmuch as $\sigma_{22}$ and $\sigma_{33}$ are nearly horizontal and differ by only 110 psi, the shear provided by horizontal tectonic stresses is too small to have an important influence on the blasting results.

b. The strikes and dips of a random sample of joints exposed in the underground workings are measured and plotted on a Schmidt projection, shown in FIG. 6. Three directions of dense jointing as follows are disclosed by this plot:

| | | |
|---|---|---|
| Center of Circle 1: | $\hat{\phi}_1 = 90°$ | $\hat{\sigma}_1 = 0°$ |
| Center of Circle 2: | $\hat{\phi}_2 = 66°$ | $\hat{\sigma}_2 = 0°$ |
| Center of Circle 3: | $\hat{\phi}_3 = 87°$ | $\hat{\sigma}_3 = 280°$ |

c. Since tectonic stresses can be neglected, and since the center of Circle 1 defines a nearly vertical jointing direction that contains a clear majority of joints, horizontal directions $\beta_1$ and $\beta_1'$ that are inclined 60° from a densely jointed direction are $\beta_1 = 60°$ true and $\beta_1' = 300°$ true.

d. Sets of 25 horizontal evenly spaced (80 feet) parallel lines are constructed perpendicular to the directions 60° true and 300° true (i.e., perpendicular to $\beta_1$ and $\beta_1'$), as shown in FIG. 7. The intersections of these two sets of lines are evenly spaced locations on the lines, and are chosen as borehole locations. The borehole locations are paired as shown in FIG. 7 so that members of each pair lie on the same line and approximately equal numbers of evenly interspersed pairs lie along both of the sets of parallel lines. (Other arrangements that meet these conditions also exist.) The boreholes are then drilled to a depth of at least 850 feet. The holes are then reamed with an expansion bit to increase their diameter over the depth interval 600–850 feet. Pairs of boreholes, as chosen above, are loaded with explosives up to approximately the 600 foot level and detonated simultaneously. Another adjacent pair of holes is then loaded and detonated simultaneously. The borehole size and explosive are the same as those in Example 1. This process is continued until all boreholes in the pattern have been detonated, the detonations alternating from one set of parallel lines to the other to shear the shale back and forth. The fragmentation of the shale is increased as evidenced by core fragment size measurements.

EXAMPLE 3

Blasting is to be undertaken and then a trench excavated along the center of a city street so as to obtain good rock breakage, yet to minimize the amount of explosive required per round and to maximize the amount of rock broken per pound of explosive. The rock is a sedimentary formation that is densely jointed parallel to well-defined bedding planes that dip 33° in the direction 160° true. The trench is to run in the direction 100° true.

In this case, tectonic stresses are neglected. The blasting is arranged to exploit the jointing parallel to the bedding.

Figure 8:
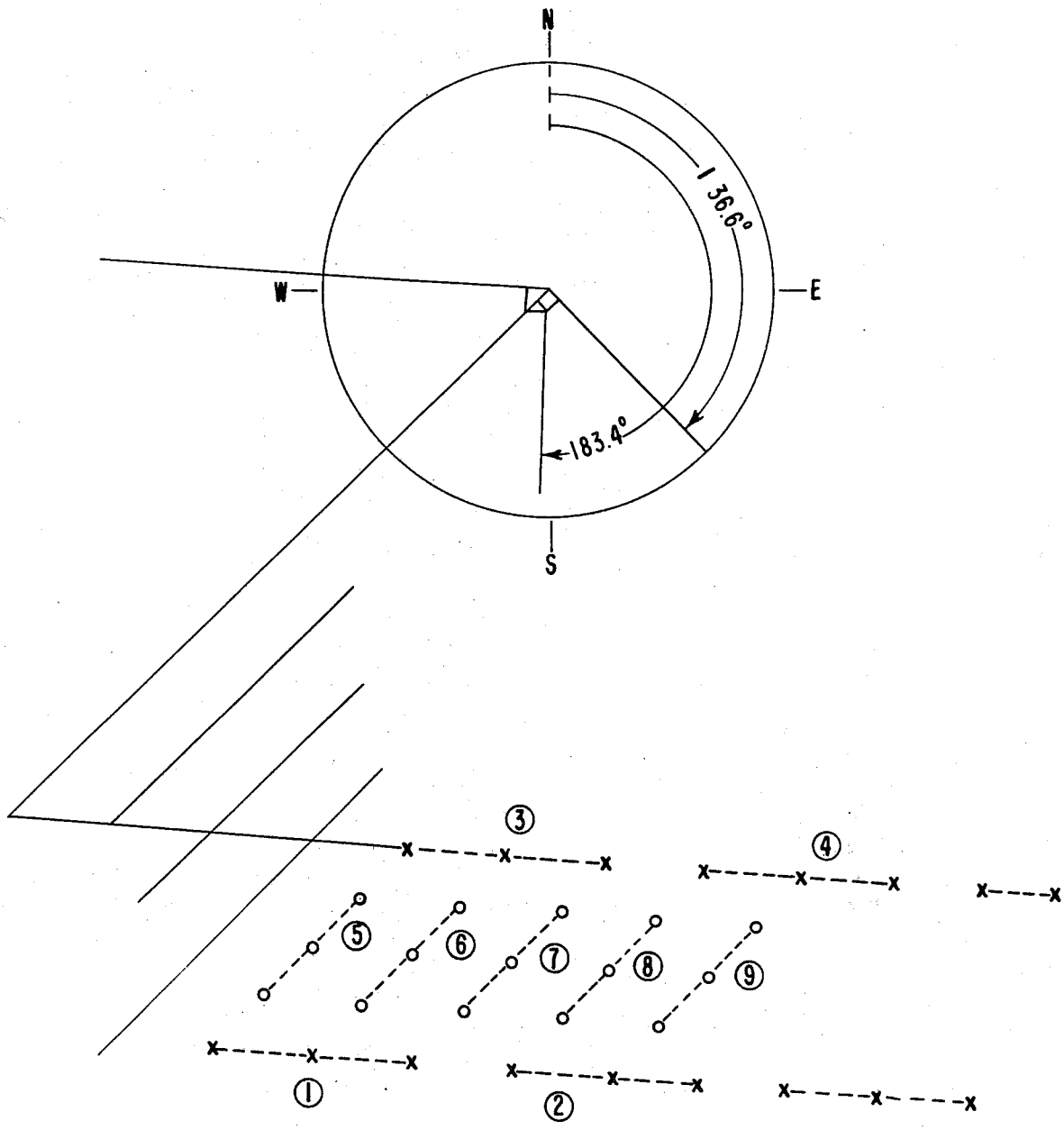
FIG. 8 is a drill hole pattern laid out for a trenching operation described in Example 3.

The strike and dip of the bedding give:

$\hat{\phi}_1 = 33°$ $\hat{\sigma}_1 = 160°$ $\beta_1 = 160° + 23.4° = 183.4°$ $\beta_1' = 160° - 23.4° = 136.6°$ The borehole arrangement based on these values is shown in FIG. 8. In order to minimize backbreak, the rock is pre-sheared with reduced charges shot in 1.5-inch-diameter holes drilled along the outline of the trench (groups of holes denoted 1, 2, 3, and 4). The direction in which the trench is being driven makes $\beta_1'$ a more favorable thrust direction than $\beta_1$. Consequently, each set of holes to be simultaneously detonated (i.e., groups denoted 5, 6, 7, 8, and 9) to break up the rock within the pre-sheared perimeter is drilled on a line perpendicular to 136.6° true. The explosive used to similar to that described in Example 1, but contains no aluminum. The groups are detonated in numerical order starting with Group 1.

The holes in each of these groups of holes are detonated simultaneously, and there is an appreciable time interval between the detonation of one group and that of the next. The rock is effectively broken from the detonations.

I claim:

1. A method of generating a directed thrust in rock comprising:

a. forming in the rock a group of adjacent drill holes which lie substantially in a common plane whose normal defines a predetermined thrust direction, said plane being oriented in a manner such that the thrust direction is at an angle in the range of about from 40° to 80° to a representative normal of any densely populated joint set in the rock;

b. loading the drill holes with explosive charges; and c. detonating the charges in the group of drill holes substantially simultaneously, whereby the group-detonation exerts a thrust against the rock in the predetermined thrust direction.

2. A method of claim 1 wherein said group of drill holes are formed so as to lie in a substantially vertical common plane.

3. A method of claim 1 wherein said group of drill holes are formed in a manner such that the thrust direction defined by the normal to their common plane is a direction which, in addition, is closest to the direction of a maximum principal tectonic stress.

4. A method of claim 1 wherein multiple groups of drill holes are formed, the substantially simultaneously detonated groups of charges being detonated in succession with respect to other such groups, whereby each group-detonation in the succession exerts a thrust against the rock.

5. A method of generating a succession of directed thrusts in rock, each by the substantially simultaneous detonation of explosives in an oriented coplanar group of adjacent holes in the rock, comprising:

a. forming substantially vertical drill holes in the rock in a pattern of a plurality of groups of adjacent drill holes, the holes in each group lying substantially in a common plane whose normal defines a predetermined thrust direction, said plane being oriented in a manner such that the thrust direction is a substantially horizontal direction that is at an angle in the range of about from 40° to 80° to a representative normal of any densely populated joint set in the rock;

b. loading the drill holes with explosive charges; and c. detonating the charges in a pattern such that the charges in each drill hole group detonate substantially simultaneously and the substantially simultaneously detonated groups of charges are detonated in succession with respect to other such groups, whereby each group-detonation in the succession exerts a thrust against the rock, the time interval between the detonations of successive groups of charges being sufficient to permit the pressure in the vicinity of the next group of charges to return to its ambient level.

6. A method of claim 5 further including the step of determining said representative normal of a densely populated joint set by (a) measuring the colatitude and azimuth of the normal of each joint in a randomly chosen sample of joints, (b) plotting the measured coordinates of each normal as the point where it will intersect a sphere centered on the normal, and (c) determining the density of the plotted points as a function of position on the surface of the sphere, the direction of the representative normal of a densely populated joint set being a direction such that at least 5% of the sample of joint normals lie within 10.37° of it.

7. A method of claim 5 wherein said group of drill holes are formed in a manner such that the thrust direction defined by the normal to their common plane is a direction which, in addition, is closest to the direction of a maximum horizontal principal tectonic stress.

8. A method of claim 7 further including the step of measuring the magnitude and direction of the horizontal components of the tectonic stress in the rock by a stress relief method.

9. A method of claim 7 further including the step of measuring the magnitude and direction of the horizontal components of the tectonic stress in the rock by an hydraulic fracturing method.

10. A method of claim 5 wherein said group of drill holes are formed in a manner such that the thrust direction defined by the normal to their common plane is at an angle of substantially 60° to said representative normal of any joint set.

11. A method of claim 5 wherein successive groups of charges are detonated at intervals of at least about 10 milliseconds.

12. A method of claim 5 wherein about from two to eight drill holes are formed in the rock per group lying substantially in a common plane.

13. A method of claim 12 wherein two drill holes are formed in the rock per group lying substantially in a common plane.

14. A method of claim 5 wherein said drill hole groups lie in a plurality of parallel planes.

15. A method of claim 14 wherein the holes of a plurality of said drill hole groups lie in a common plane.

16. A method of claim 15 wherein said drill hole groups are formed in a manner such that said plurality of parallel planes intersect a plurality of parallel planes in which other such drill hole groups lie, and drill hole groups are detonated, alternating between groups lying on the two intersecting sets of parallel planes.

17. A method of claim 1 wherein said directed thrust is generated in a deep segment of mineralized rock so as to produce a network of fractures therein to prepare said segment for the in situ recovery of mineral values therefrom.

* * * * *